US005562374A

United States Patent [19]

Plamper

[11] Patent Number: 5,562,374

[45] Date of Patent: Oct. 8, 1996

[54] CONTAINER SYSTEM FOR ONE-LEVEL AND TWO-LEVEL FREIGHT CARS AND DOUBLE-DECK COACHES, ESPECIALLY FOR HIGH-SPEED TRAINS

[75] Inventor: Rudolf Plamper, Berlin, Germany

[73] Assignee: Institut Für Schienenfahrzeuge GmbH, Berlin, Germany

[21] Appl. No.: 572,155

[22] Filed: Dec. 8, 1995

Related U.S. Application Data

[63] Continuation of Ser. No. 143,565, Oct. 26, 1993, abandoned.

[30] Foreign Application Priority Data

Oct. 26, 1992 [DE] Germany ..... 42 36 513.9

[51] Int. Cl.[6] ..... B60P 7/13; B61D 45/00

[52] U.S. Cl. ..... 410/66; 410/77; 410/93; 410/94; 105/1.1; 105/355

[58] Field of Search ..... 410/66, 67, 77, 410/84, 90, 93, 94, 121, 153; 105/1.1, 355; 220/1.5

[56] References Cited

U.S. PATENT DOCUMENTS

| | | | |
|---|---|---|---|
| 1,360,412 | 11/1920 | Kirchner | 410/67 |
| 2,538,531 | 1/1951 | Likens | 410/93 X |
| 3,147,869 | 9/1964 | Fujioka et al. | 410/93 |
| 3,180,281 | 4/1965 | Sherrie et al. | 410/67 X |
| 3,228,352 | 1/1966 | La Mar Johnson | 410/1 |
| 3,690,272 | 12/1972 | Ogle et al. | 410/77 |
| 3,945,677 | 3/1976 | Servais et al. | 105/1.1 X |
| 4,478,155 | 10/1984 | Cena et al. | 410/77 X |
| 4,746,160 | 5/1988 | Weisemeyer | 105/1.1 X |
| 5,392,717 | 2/1995 | Hescl et al. | 105/355 X |

FOREIGN PATENT DOCUMENTS

| | | | |
|---|---|---|---|
| C530410 | 7/1931 | Germany . | |
| C531422 | 9/1931 | Germany . | |
| 2310157 | 1/1973 | Germany | 410/66 |
| 3616484 | 11/1987 | Germany . | |
| 9116376 | 8/1992 | Germany . | |
| 4-59469 | 2/1992 | Japan | 105/1.1 |
| 485962 | 5/1938 | United Kingdom | 410/77 |

OTHER PUBLICATIONS

ETR 40, 1991, vol. 12, p. 795.

*Primary Examiner*—Karen Merritt
*Assistant Examiner*—Stephen Gordon
*Attorney, Agent, or Firm*—Cohen, Pontani, Lieberman, Pavane; Christa Hildebrand

[57] ABSTRACT

A container system for one-level and two-level freight cars and double-deck coaches, especially for high-speed trains. The object is to ensure safe shipping at high speeds along with simple and well conceived loading and unloading. The containers are stowed inside the car or coach and secured for shipment by stops. The fronts of the containers are coplanar with the outer surface of the car or coach and constitute a continuous surface with its side. The car or coach is provided with mechanisms that lock the container into position without compromising the continuity of the surface, and any residual gaps around the edges of the containers are occupied by sealing strips.

4 Claims, 3 Drawing Sheets

CONTAINER SYSTEM FOR ONE-LEVEL AND TWO-LEVEL FREIGHT CARS AND DOUBLE-DECK COACHES, ESPECIALLY FOR HIGH-SPEED TRAINS

This is a continuation, of application Ser. No. 08/143,565, filed Oct. 26, 1993, and now abandoned.

BACKGROUND OF THE INVENTION

1. Field of the Invention

The present invention relates to a container system for one-level and two-level freight cars and double-deck coaches especially for high-speed trains, with smooth outer-surface walls with no gaps between the containers, with between-the-wheels floors, and with break-off edges in front and in back of the trucks, wherein the containers are stowed inside the car or coach and secured for shipment by stops, the fronts of the containers are coplanar with the outer surface of the car or coach and constitute a continuous surface with the side of the car or coach, the car or coach is provided with mechanisms that lock the container into position without compromising the continuity of the surface, and any residual gaps around the edges of the containers are occupied by sealing strips.

2. Description of the Related Art

In known container-shipping systems all different types of containers regardless of shape and size are secured to the bed of a flatcar. The car and container have matching fastening and securing devices.

The double-deck coaches known from GM 9 116 376.5 can also accommodate large containers. Containers and unified large-capacity boxes are loaded through appropriate lateral hatchways into holds on the lower deck and secured there. Facilities permitting the stowage of large containers for high-speed shipment in most known freight and passenger cars, however, are limited, and the items can be loaded into boxcars only through special doorways.

U.S. Pat. No. 3,147,869 discloses aligning and locking containers so close together on the bed of a flatcar that their sides constitute a lateral surface that is almost continuous, with only the locking mechanisms projecting. Such an exposed array is of limited practicality for high-speed trains.

ETR 40 (1991), Volume 12, page 795 discloses stowing electric vehicles crosswise in two-level freight cars. Since the cars are then enclosed, this system can be employed with high-speed trains. There is a drawback in that special equipment, louvered panels for example, has to be manufactured.

The same drawback is encountered in the railroad-car loading system known from DE 3 616 484.A1.

SUMMARY OF THE INVENTION

The object of the present invention is to provide an improved container arrangement which ensures safe shipping of containers at high speeds along with simple and well conceived loading and unloading.

This object is attained in accordance with the invention in that the fronts of the containers when locked within the car constitute the car's almost continuous smooth lateral surface, which the addition of specially designed seals, fasteners, and locking mechanisms will render smooth enough to satisfy the demands for streamlining and noise reduction associated with high speeds in particular.

DESCRIPTION OF THE PREFERRED EMBODIMENTS

Figure 1:
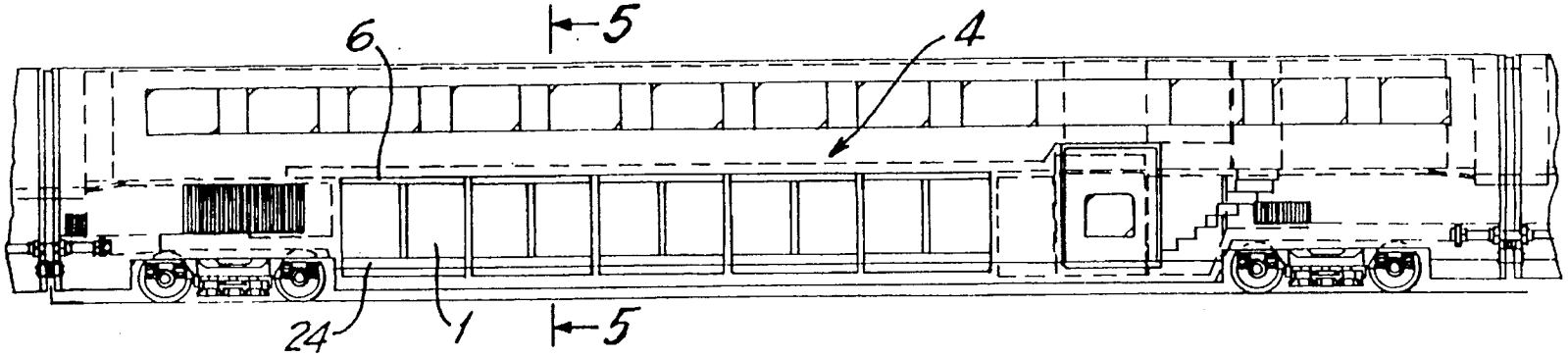
FIG. 1 is a side view of a double-deck railroad coach with containers stowed on the lower deck.
Figure 5:
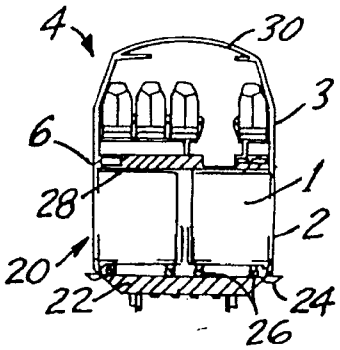
FIG. 5 is a cross sectional view taken along the lines A—A in FIG. 1.
Figure 2:
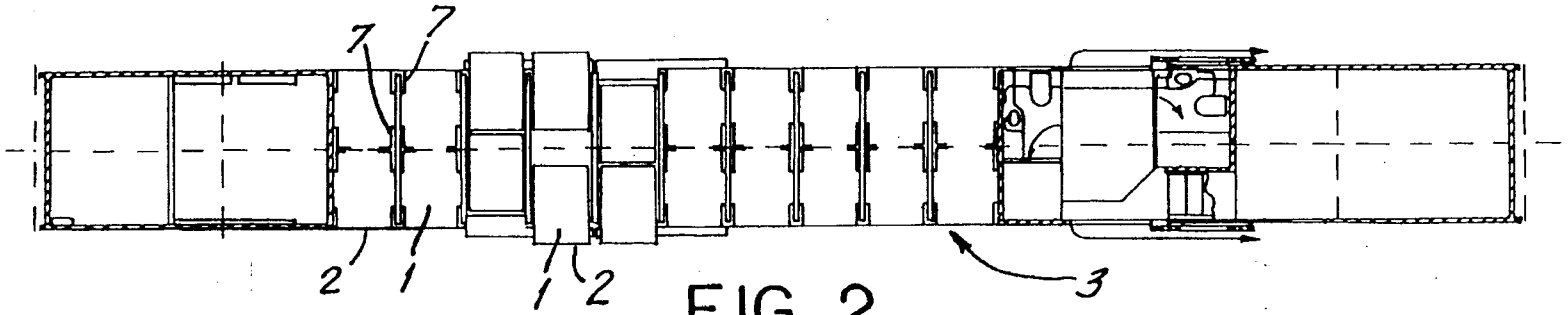
FIG. 2 is a longitudinal section through the lower deck of the coach of FIG. 1.

Two embodiments of the invention will now be specified with reference to the drawings. According to FIGS. 1, 2 and 5 several containers 1 are stowed in the lower deck 20 of the double-deck coach 4. Once containers 1 have been inserted completely, their fronts 2 constitute a continuous surface in conjunction with the side 3 of coach 4.

Figure 6:
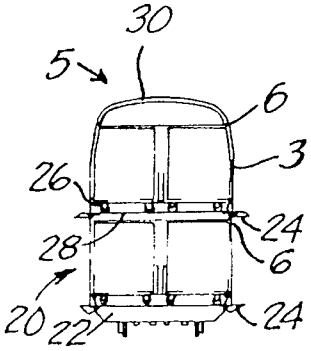
FIG. 6 is a cross sectional view taken along the lines B—B in FIG. 3.
Figure 8:
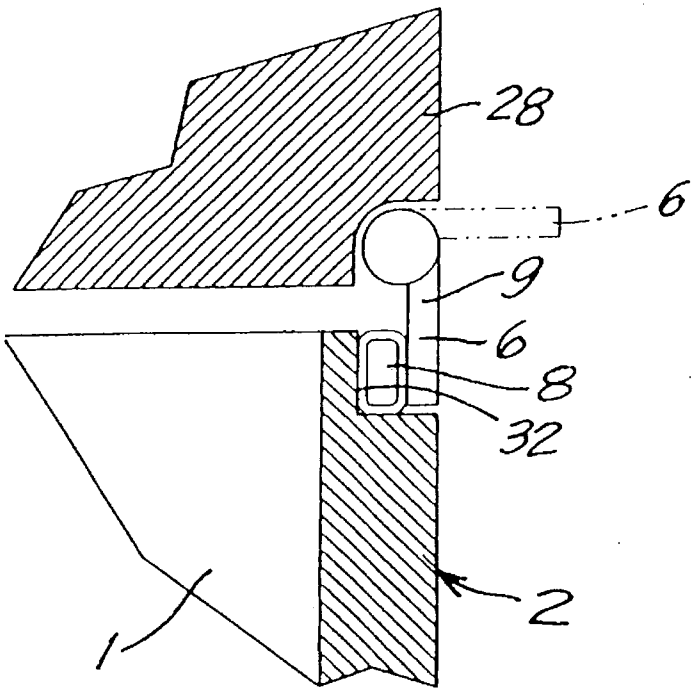
FIG. 8 is a cross sectional view of an upper locking mechanism.
Figure 7:
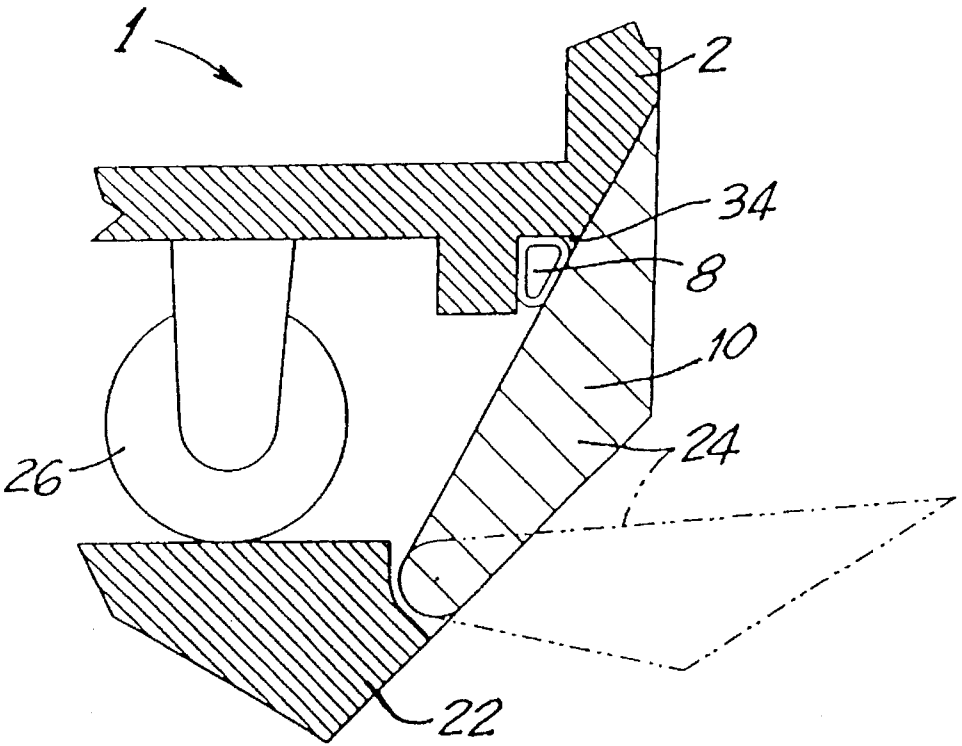
FIG. 7 is a cross sectional view of a lower locking mechanisms.

Containers 1 are slid into their final position on the floor 22 of coach 4 by known loading mechanisms such as being rolled on wheels 26. The lateral stops 7 illustrated in FIG. 2 prevent the containers frown sliding too far into the car. Upper locking mechanisms 6 are pivotally connected to a top edge of the lower deck 20 on the side 3 of the coach 4 through which the containers 1 enter, e.g. to a dividing floor 28 or roof 30, and act to seal the containers within the coach and, when locked, are received by and engage the container at a point 32 fitting flush against the side 3 of the coach 4 constituting lintels 9 as is depicted in FIG. 8. Lower locking mechanisms 24 are pivotally connected to the floor 22 of the coach 4 and swing down to create fillers as seen in FIG. 7 between the floor 22 and the edge of the loading platform (not shown) for the containers 1 to roll over while they are being loaded, and when locked pivot to be received by and engage the container 1 at a point 34 locking the container 1 within the coach 4. Additional such locking mechanisms can be provided on the far side of the coach as well as seen in FIG. 6. All the locking mechanisms prevent containers 1 from sliding out of the car. When upper locking mechanisms 6 are folded down to become lintels 9 and lower locking mechanisms 24 are folded back, locking mechanisms 6, 24, the fronts 2 of containers 1, and the side 3 of coach 4 will together constitute a smooth and continuous surface. Strips 8 are positioned between the container 1 and upper and lower locking mechanisms 6 and 24 respectively to seal off any gaps and render the interior of the car desirably weather tight.

Figure 3:
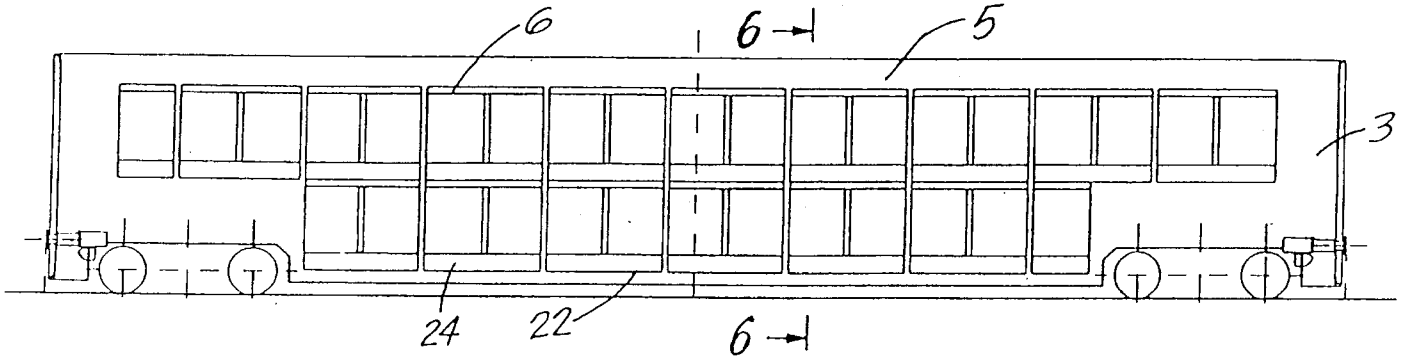
FIG. 3 is a side view of a two-level freight car with containers on both levels.
Figure 4:
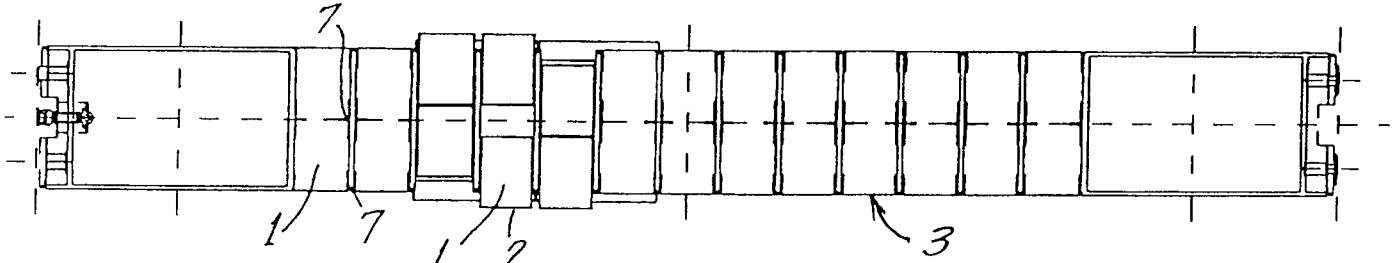
FIG. 4 is a longitudinal section through the lower deck of the freight car of FIG. 3.

FIG. 3 illustrates several containers 1 accommodated in a freight car 5 as hereinbefore specified. The containers 1 in accordance with the invention are intended for stowage on one level only but may store containers 1 on both levels as shown in FIG. 6. Known structures storing containers on one level would accordingly use the roof of the car for attachment of the upper locking mechanism 6. The inner surfaces of the locking mechanisms 6, 24 that constitute lintels 9 and fillers 10 closely match the associated areas of containers 1, ensuring a smooth fit within the coach.

The present invention allows free choice for positioning the containers 1, which can accordingly be accommodated on both sides of the car. The containers can also be loaded and unloaded from either side. Lower locking mechanisms 24 represent additional security for the bottoms of the containers 1 when the mechanisms 24 are folded down to constitute fillers 10.

I claim:

1. A container arrangement for a multi-level high speed train, said arrangement comprising:

a train car (4) including a housing having a front end, a back end, a base (22) extending between said front and back ends, a roof (30) extending parallel to and spaced from said base (22), a first smooth side (3) extending along and connecting said base (22) and roof (30) defined by at least one opening providing a passageway into and out of said housing having a top edge and bottom edge, first and second break off edges connected to said front end and back end respectively, a lateral stop (7) connected to said base (22) and within said housing, a first locking mechanism (6) pivotally connected to said top edge and a second locking mechanism (24) pivotally connected to said bottom edge;

at least one container (1) including first and second means for receiving and engaging (32, 34) said first and second locking mechanism (6, 24), respectively; and sealing strips (8) positioned between said first receiving means and first locking mechanism and said second receiving means and second locking mechanism, said at least one container (1) being movable between a first position in which said at least one container (1) is secured within said housing and flush with said first smooth side (3) so that said at least one container, first and second locking mechanisms and first smooth side form a continuous smooth outer surface and a second position in which said at least one container (1) is positioned external to said housing, said sealing strips (8) positioned to fill any gaps between said at least one container (1) and said first smooth side (3) when said at least one container (1) is in said first position.

2. The container arrangement of claim 1, further comprising a second smooth side defining at least one opening into said housing having a top edge and a bottom edge, a third locking mechanism pivotally connected to said top edge and a fourth locking mechanism pivotally connected to said bottom edge, the at least one opening defined by said second side providing a passageway for said at least one container to enter and exit said housing.

3. The container arrangement of claim 1, further comprising a dividing floor positioned within said housing and extending parallel to and spaced from said base dividing said housing into first and second levels.

4. The container arrangement of claim 1, wherein said second locking mechanism is pivotable between a first position engaging said second means for receiving and a second position extending from said housing to form a loading platform.

* * * * *